US007311082B2

(12) United States Patent
Yokoi

(10) Patent No.: US 7,311,082 B2
(45) Date of Patent: Dec. 25, 2007

(54) STRADDLE TYPE VEHICLE HAVING AN ELECTRONIC THROTTLE VALVE SYSTEM

(75) Inventor: Masato Yokoi, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/408,590

(22) Filed: Apr. 20, 2006

(65) Prior Publication Data

US 2006/0243246 A1 Nov. 2, 2006

(30) Foreign Application Priority Data

May 2, 2005 (JP) ..... 2005-133781
Apr. 6, 2006 (JP) ..... 2006-105060

(51) Int. Cl.
*F02D 9/02* (2006.01)
*F02D 45/00* (2006.01)

(52) U.S. Cl. ..... 123/399; 123/400; 180/219

(58) Field of Classification Search ..... 123/361, 123/396, 399, 400; 180/219
See application file for complete search history.

(56) References Cited

U.S. PATENT DOCUMENTS 4,940,109 A 7/1990 Preston et al. ..... 180/197
5,297,521 A * 3/1994 Sasaki et al. ..... 123/396
5,447,133 A * 9/1995 Kamio et al. ..... 123/396
5,778,853 A * 7/1998 Saito ..... 123/396
6,910,546 B2 * 6/2005 Tsutsumi et al. ..... 180/219
7,156,074 B2 * 1/2007 Hanasato ..... 123/399
2004/0198109 A1 10/2004 Ochiai ..... 440/87
2005/0211220 A1 * 9/2005 Matsuda ..... 123/399

FOREIGN PATENT DOCUMENTS

DE 39 40 178 6/1991
FR 2 728 835 7/1996
JP 2002-106368 4/2002

* cited by examiner

*Primary Examiner*—T. M. Argenbright
(74) *Attorney, Agent, or Firm*—Hogan & Hartson LLP

(57) ABSTRACT

An electronic throttle valve system more suitable for use in straddle type vehicles. A straddle type vehicle has an electronic throttle valve system for adjusting the amount of intake air to an internal combustion engine. The electronic throttle valve system includes a throttle valve for adjusting the amount of intake air to the internal combustion engine, an electric motor for actuating the throttle valve, and a control unit for controlling the electric motor. The throttle valve is fixed to a valve shaft. The electric motor is connected to the valve shaft. The valve shaft is provided with a throttle opening sensor on the right end, and a mechanical, throttle valve actuating mechanism on the left end. A throttle cable is engaged with the mechanism, while being coupled to a throttle grip (acceleration controller) provided on a right one of a pair of handlebars.

4 Claims, 5 Drawing Sheets

STRADDLE TYPE VEHICLE HAVING AN ELECTRONIC THROTTLE VALVE SYSTEM

BACKGROUND OF THE INVENTION

1. Field of the Invention

The present invention relates to a straddle type vehicle (e.g. two-wheeled motor vehicle), and particularly to a straddle type vehicle having an electronic throttle valve system for adjusting the amount of intake air to an internal combustion engine of the vehicle.

2. Description of Related Art

An electronic throttle valve system for electronically controlling the opening of a throttle valve to adjust the amount of intake air to an engine (internal combustion engine) can advantageously reduce emission and fuel consumption. This system has been used in some four-wheeled motor vehicles. Application of the system to two-wheeled motor vehicles has been under discussion (See JP-A-2002-106368, for example).

However, as different from four-wheeled motor vehicles, there is housing space limitation in the case of two-wheeled motor vehicles.

As compared to the case of four-wheeled motor vehicle having relatively less restrictions, the type of layout by which the type of mechanism is to be mounted cannot be determined simply, but is to be determined under severe restrictions.

SUMMARY OF THE INVENTION

The present invention is derived from the foregoing problem. A principal object of the invention is to provide an electronic throttle valve system more suitable for use in a straddle type vehicle, and a straddle type vehicle having the electronic throttle valve system.

The present invention provides a straddle type vehicle having an electronic throttle valve system for adjusting the amount of intake air to an internal combustion engine. The electronic throttle valve system includes a throttle valve for adjusting the amount of intake air to the internal combustion engine, an electric motor for actuating the throttle valve, and a control unit for controlling the electric motor. The throttle valve is fixed to a valve shaft. The electric motor is connected to the valve shaft and is located for actuating the throttle valve through the valve shaft. The valve shaft is provided with, on a right end thereof, a throttle opening sensor for detecting the opening of the throttle valve. The valve shaft is provided with, on a left end thereof, a mechanical, throttle valve actuating mechanism with which a throttle cable is engaged. The throttle cable is coupled to a throttle grip provided on a right one of a pair of handlebars of the straddle type vehicle.

The present invention provides a straddle type vehicle having an electronic throttle valve system for adjusting the amount of intake air to an internal combustion engine. The electronic throttle valve system includes a throttle valve for adjusting the amount of intake air to the internal combustion engine, an electric motor for actuating the throttle valve, and a control unit for controlling the electric motor. The throttle valve is fixed to a valve shaft. The electric motor is connected to the valve shaft and is located for actuating the throttle valve through the valve shaft. The valve shaft is provided with, on a right end thereof, a throttle opening sensor for detecting the opening of the throttle valve. The valve shaft is provided with, on a left end thereof, a mechanical, throttle valve actuating mechanism with which a throttle cable is engaged. The throttle cable is coupled to an acceleration controller provided on a right one of a pair of handlebars of the straddle type vehicle.

According to one preferred embodiment of the invention, the mechanical throttle valve actuating mechanism has a structure for actuating the throttle valve in conjunction with the operation of the throttle grip, in the event that the electric motor stops actuating the throttle valve.

According to one preferred embodiment of the invention, the mechanical throttle valve actuating mechanism is provided with an accelerator-opening sensor for detecting the displacement of the acceleration controller. The accelerator-opening sensor is in electrical connection with the control unit. The control unit controls the electrical motor based on the opening of the acceleration controller detected by the accelerator-opening sensor.

According to one preferred embodiment of the invention, the electric motor is connected via a drive gear to a midsection between the right end and the left end of the valve shaft.

According to one preferred embodiment of the invention, the valve shaft extends in the lateral direction of the straddle type vehicle, and the accelerator-opening sensor and the electric motor are located either forward or rearward of the valve shaft.

According to one preferred embodiment of the invention, the throttle cable extends from the throttle grip to the left end of the valve shaft with a greater curvature of the cable, compared to the case where the cable extends to the right end of the valve shaft or the midsection between the right end and the left end thereof.

Preferably, the straddle type vehicle is a two-wheeled motor vehicle with the electronic throttle valve system and the mechanical, throttle valve actuating mechanism both installed inside a body frame.

According to the invention, in a straddle type vehicle having the electronic throttle valve system, the throttle opening sensor is provided on the right end of the valve shaft of the throttle valve, while the mechanical throttle valve mechanism is provided on the left end of the valve shaft of the throttle valve. The throttle cable is engaged with the mechanism. This allows the throttle cable to be disposed with an appropriate curvature, resulting in establishment of the electronic throttle valve system that is more suitable for use in two-wheeled motor vehicles.

DETAILED DESCRIPTION OF THE INVENTION

With regard to two-wheeled motor vehicles that include an electronic throttle valve system, the inventor studied the type of electronic throttle valve system to be used, and how it should be provided, thereby leading to the accomplishment of the present invention.

With reference to the appended drawings, embodiments of the present invention will be described below. However, the present invention is not limited to these embodiments.

Figure 1:
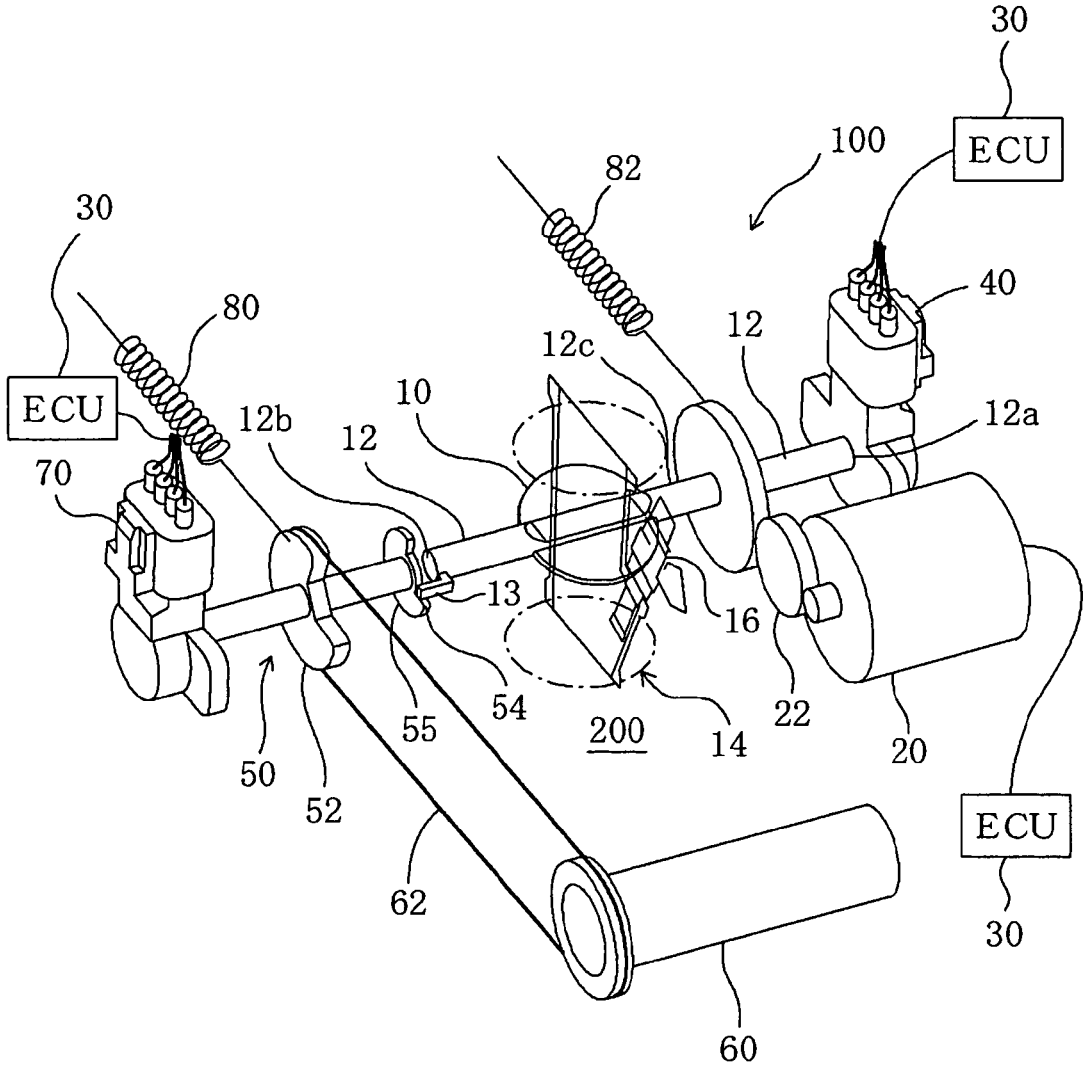
FIG. 1 is a perspective view, schematically showing a configuration of an electronic throttle valve system according to an embodiment of the present invention.

With reference to FIG. 1, an electronic throttle valve system according to an embodiment of the invention is described. FIG. 1 is a perspective view schematically showing a configuration of the electronic throttle valve system 100 according to this embodiment.

The electronic throttle valve system 100 is mounted on a straddle type vehicle (e.g. two-wheeled motor vehicle) to adjust the amount of intake air to an internal combustion engine 200 of the vehicle. The electronic throttle valve system 100 includes a throttle valve 10 for adjusting the amount of intake air to the internal combustion engine 200, an electric motor 20 for driving the throttle valve 10, and a control unit (ECU: electronic control unit) 30 for controlling the electric motor 20.

The throttle valve 10 is fixed to a valve shaft 12. The throttle valve 10 of this embodiment, which is a butterfly throttle valve, is disposed within a throttle body 14. The throttle body 14 is provided with a fuel injector 16 for injecting fuel. FIG. 1 solely illustrates one throttle valve 10 for easier understanding, although plural throttle valves 10 are typically provided within the throttle body 14.

The electric motor 20 is connected to the valve shaft 12 of the throttle valve 10 so that the electric motor 20 can actuate the throttle valve 10 through the valve shaft 12. In this embodiment, the electric motor 20 is connected to a midsection 12*c* between a right end 12*a* and a left end 12*b* of the valve shaft 12. FIG. 1 illustrates the electric motor 20 connected to the valve shaft 12 through a drive gear 22. The electric motor 20 is in electrical connection with the ECU 30.

At the right end 12*a* of the valve shaft 12 is provided a throttle opening sensor 40 for detecting the opening of the throttle valve 10. The throttle opening sensor 40 is in electrical connection with the ECU 30.

In contrast, at the left end 12*b* of the valve shaft 12 is provided a mechanical, throttle valve mechanism (hereinafter referred to as a "guard mechanism") 50. The guard mechanism 50 is designed to actuate the throttle valve 10 in conjunction with the operation of a throttle grip 60 in the event that the electric motor 20 stops actuating the throttle valve 10. The throttle grip 60 is provided on a right one of a pair of handlebars (not shown) of the straddle type vehicle. A throttle cable 62 connected to the throttle grip 60 is engaged with the guard mechanism 50. The throttle grip 60 is an acceleration controller. A lever, which has a similar function to the throttle grip, may also be employed as the acceleration controller. The form of acceleration controller is not limited to the throttle grip.

In this embodiment, the guard mechanism 50 includes a pulley 52 with which the throttle cable 62, connected to the throttle grip 60, is engaged and a lever pulley 54 which rotates in conjunction with the opening of the pulley 52. The lever pulley 54 includes a notched portion 55 which can come into contact with a protrusion 13 extending from the valve shaft 12 of the throttle valve 10. FIG. 1 illustrates the notched portion 55 with its opening generally shaped into a sector having an angle enough to accommodate the width of the protrusion 13. As the lever pulley 54 rotates, the edge face of the notched portion 55 with its generally sector-shaped opening can come into contact with the protrusion 13.

The guard mechanism 50 is provided with an accelerator-opening sensor 70 for detecting the displacement of the acceleration controller (i.e. opening of the accelerator for the throttle grip 60). The accelerator-opening sensor 70 is in electrical connection with the ECU 30. The ECU 30 controls the electrical motor 20 based on the opening of the accelerator detected by the accelerator-opening sensor 70.

FIG. 1 illustrates three ECUs 30 for convenience of description, however, there is typically only one ECU. In other words, the typical electronic throttle valve system 100 is provided with one ECU 30. It should be noted that plural ECUs 30 may be connected to one another. In this embodiment, return springs 80, 82 are separately provided.

In the illustrative configuration shown in FIG. 1, the pulley 52 and the lever pulley 54 are coaxially coupled. However, the invention is not limited to this configuration. Both pulleys may be coupled, such that the lever pulley 54 can rotate in conjunction with the opening of the pulley 52, using a link member, for example.

Figure 2:
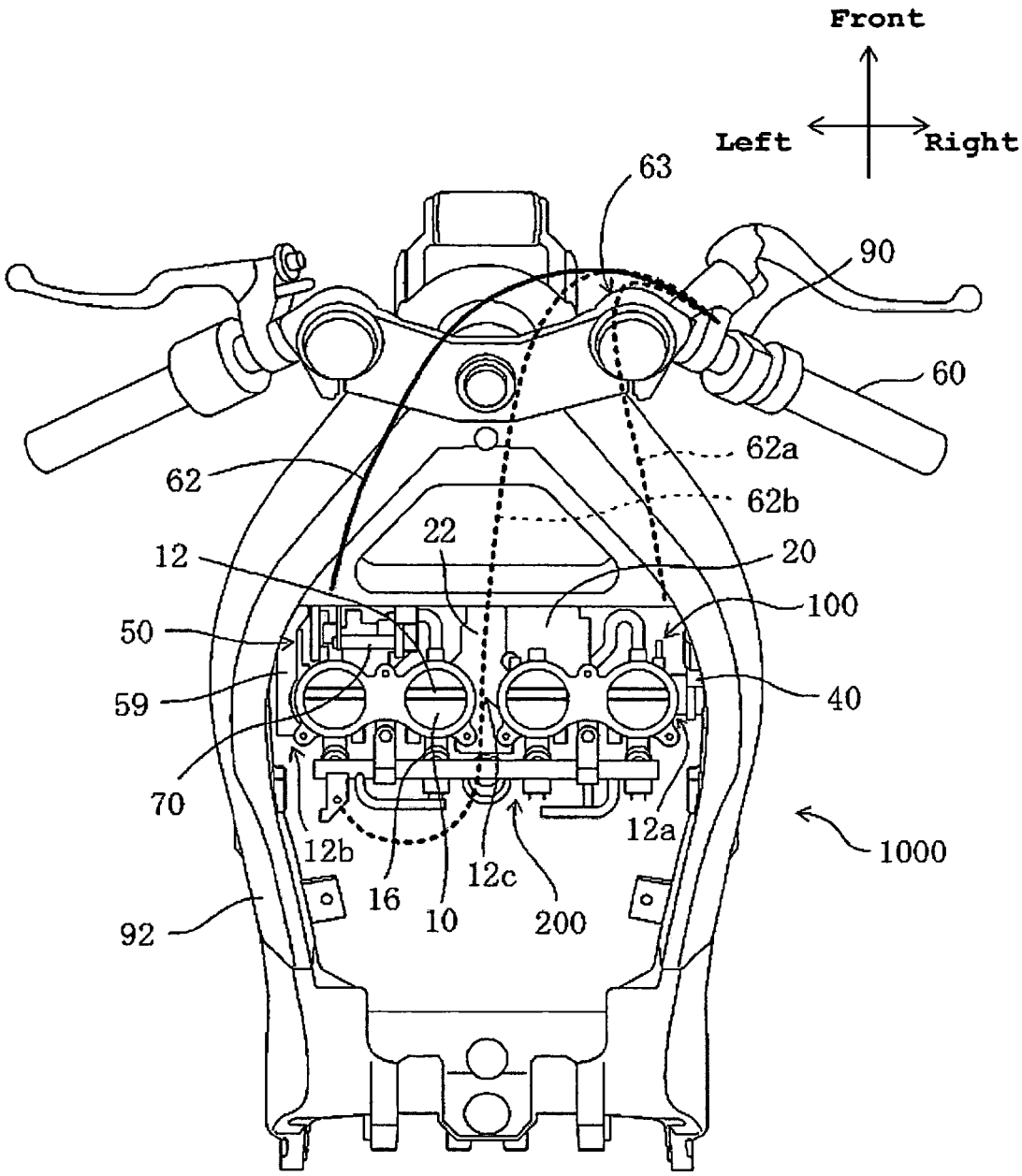
FIG. 2 is a perspective top view, showing a configuration in which the electronic throttle valve system according to an embodiment of the present invention is mounted to a two-wheeled motor vehicle.

FIG. 2 is a perspective top view, showing a configuration in which the electronic throttle valve system 100 of this embodiment is mounted on a two-wheeled motor vehicle 1000.

As shown in FIG. 2, in the two-wheeled motor vehicle 1000 of this embodiment, the throttle cable 62 extends from the throttle grip 60, which is provided on a right one of a pair of handlebars 90 of the two-wheeled motor vehicle, to connect to the guard mechanism 50. The pulley 52 and the lever pulley 54 are housed within a cover 59 of the guard mechanism 50.

In this embodiment, the throttle cable 62 extending from the throttle grip 60 is disposed by design such that the cable reaches the left end 12*b* of the valve shaft 12, in order to obtain a greater curvature of the throttle cable 62. If a throttle cable 62*a* were disposed so as to reach the right end 12*a* of the valve shaft 12, the length of the cable could be shortest, which is seemingly advantageous. However, the cable tends to be bent severely or have a small curvature 63. In addition, if a throttle cable 62*b* were disposed so as to pass the midsection 12*c* of the valve shaft 12, the curvature of the cable 62*b* could be greater relative to the throttle cable 62*a*. However, this tends to curve the throttle cable 62*b* into an S-shape when viewed from the above. Thus, the throttle cable 62 is disposed with a greater curvature to reach the guard mechanism 50 and not to be curved into an S-shape.

In the illustrative configuration shown in FIG. 2, the electronic throttle valve system 100 and the guard mechanism 50 can both be installed inside a body frame 92. In this manner, the system 100 and the mechanism 50 are both adapted to suit use in a two-wheeled motor vehicle that has a limited layout space. Due to the limited layout space, the valve shaft 12 is preferably placed so as to extend in the lateral direction of the two-wheeled motor vehicle 1000, so that the accelerator-opening sensor 70 and the electric motor 20 can be located either forward or rearward of the valve shaft 12. In the illustrative configuration, the accelerator-opening sensor 70 and the electric motor 20 are both located forward of the valve shaft 12.

Figure 3:
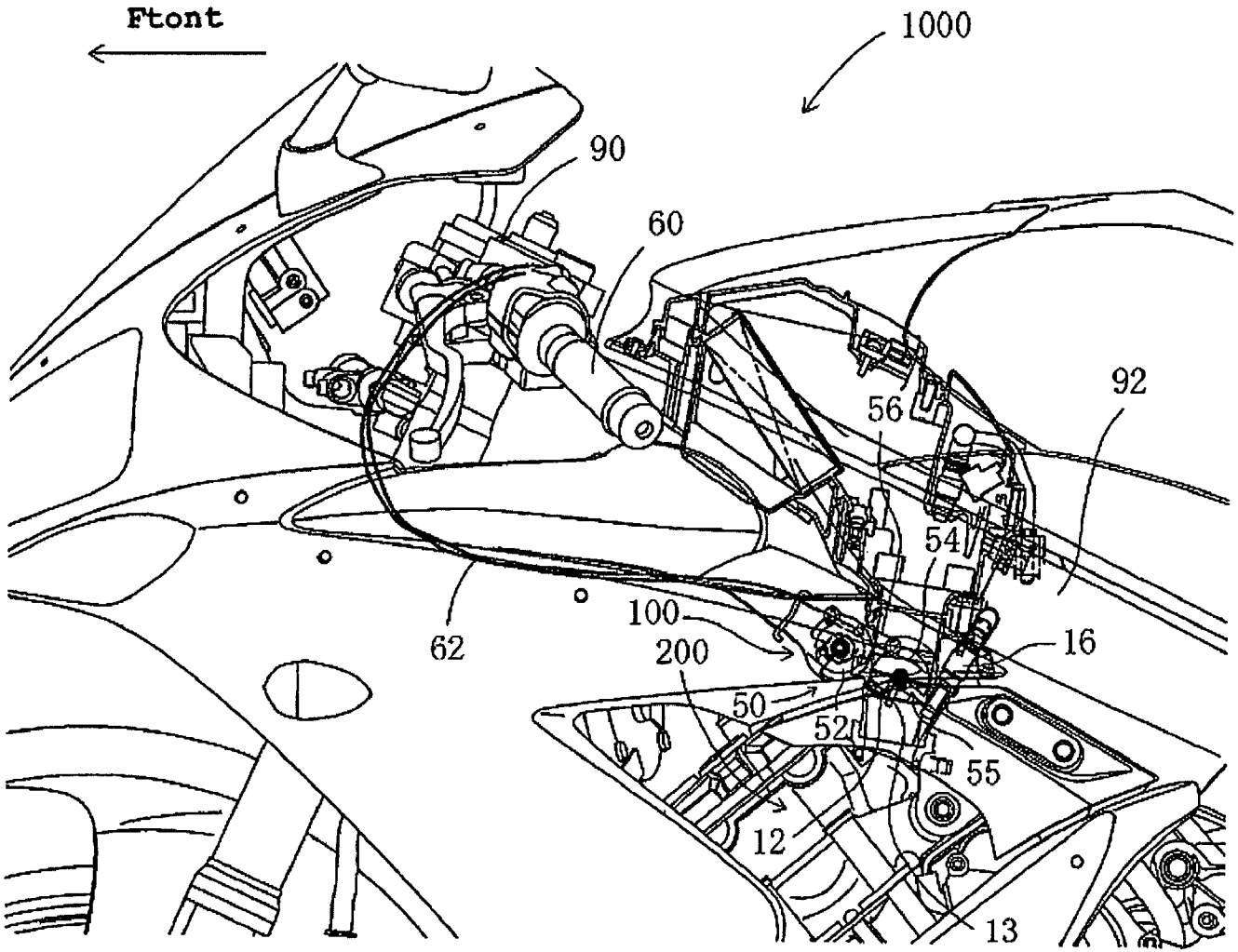
FIG. 3 is a perspective side view of the two-wheeled motor vehicle according to an embodiment of the present invention.

For reference, FIG. 3 shows a perspective side view of the two-wheeled motor vehicle 1000. As shown in FIG. 3, the throttle grip 60 lies on a left one of the pair of the handlebars. The throttle cable 62 extending from the throttle grip 60 engages with the pulley 52. FIG. 3 illustrates the pulley 52 and the lever pulley 54 coupled through a link member 56.

Figure 4:
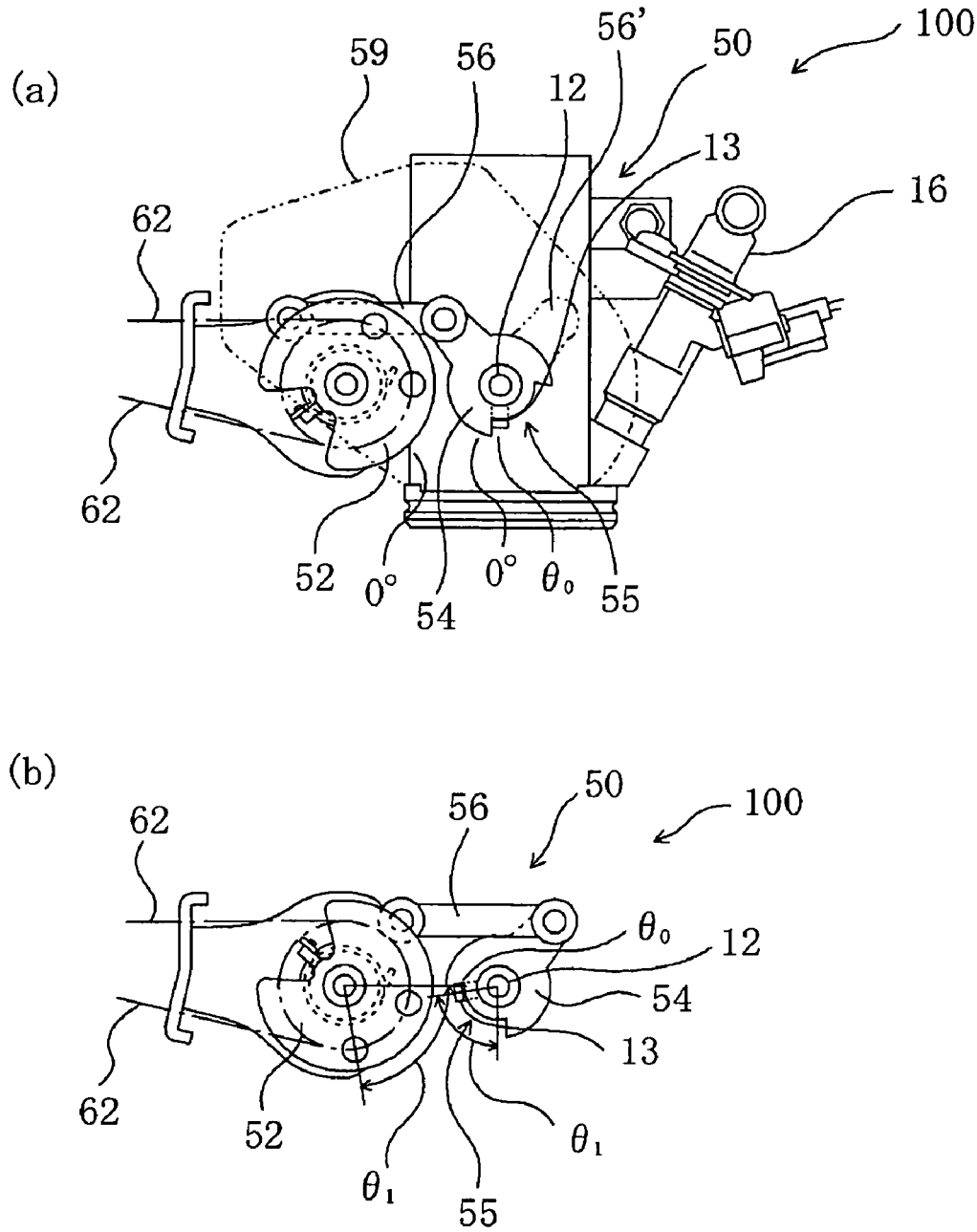
FIGS. 4(*a*) and 4(*b*) are side views, illustrating the operation of the electronic throttle valve system according to an embodiment of the present invention.
Figure 5:
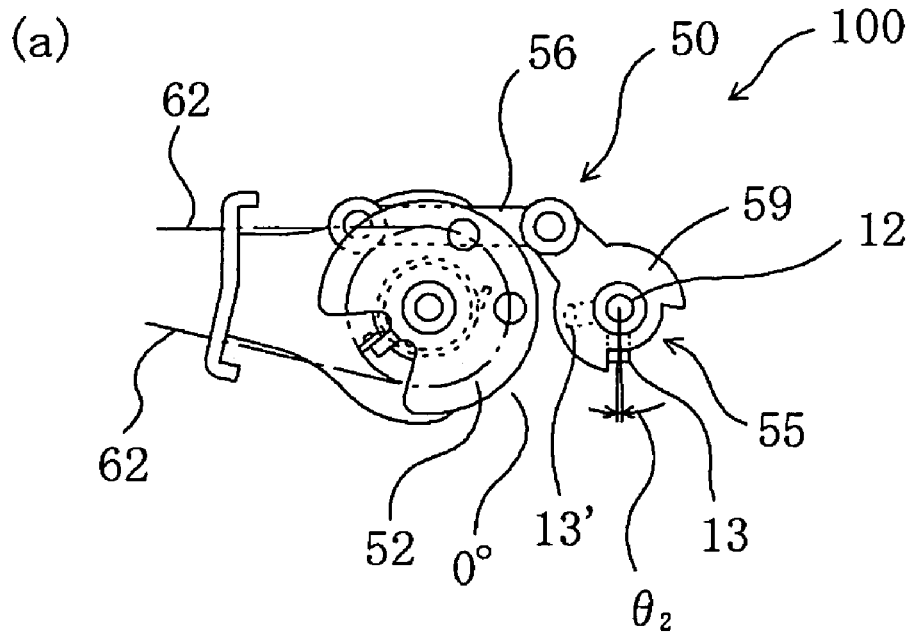
FIGS. 5(*a*) and 5(*b*) are side views, illustrating the operation of the electronic throttle valve system according to an embodiment of the present invention.
Figure 5:
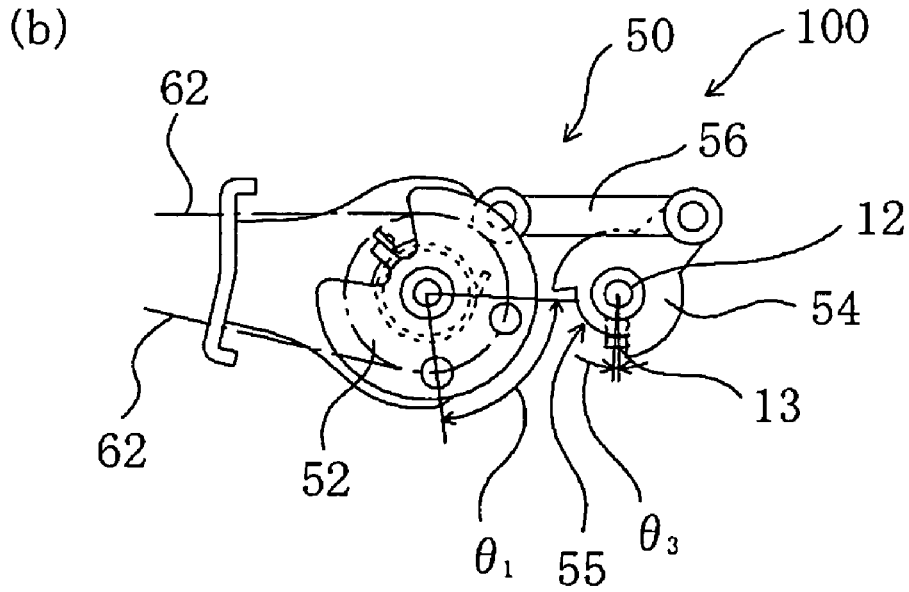

Next, with reference to FIGS. 4 and 5, the operation of the guard mechanism 50 of this embodiment will be described. FIGS. 4 and 5 are side perspective views of the guard mechanism 50 of FIG. 2.

FIGS. 4(*a*) and 4(*b*) illustrate normal throttle operation where the guard mechanism need not work. In contrast, FIGS. 5(*a*) and 5(*b*) illustrate another throttle operation where the guard mechanism works. In FIG. 4(*a*), the throttle valve is fully closed. Peripheral members, such as the injector 16 and the cover 59, are also shown in FIG. 4(*a*) for reference purpose. In FIG. 4(*b*), the throttle valve is fully opened.

Under the condition shown in FIG. 4(*a*), the pulley 52 has the opening of 0° while the protrusion (claw) 13 has the opening of 0°. The opening of the protrusion is affected by the opening of the throttle valve 10 (opening of the butterfly valve). When the protrusion 13 has the opening of 0°, there is an angular gap of $\theta_0$ (e.g. about 2°) between the edge face of the notched portion 55 of the lever pulley 54 and the protrusion 13. The link member 56 can move to a point 56' indicated by the dotted line in FIG. 4(*a*), if the throttle valve is fully opened.

When the throttle valve is fully opened, as shown in FIG. 4(*b*) following the condition of FIG. 4(*a*), the accelerator-opening sensor 70 of FIG. 1 detects the opening of the accelerator and sends data thereof to the control unit (ECU) 30. Based on the data, the ECU controls the electric motor 20 to actuate the throttle valve 10. More specifically, with reference to the side view shown in FIG. 4(*b*), as the pulley 52 rotates, the pulley 52 has the opening of $\theta_2$ (e.g. 80°) and therefore the throttle valve 10 has the opening (i.e. opening of the protrusion 13) of $\theta_1$ (e.g. 80°). As the pulley 52 rotates, the lever pulley 54 also rotates through the link member 56. This allows the edge face of the notched portion 55 of the lever pulley 54 to move in the same manner.

Under the condition shown in FIG. 4(*b*), in the event that the motor 20 stops actuating the throttle valve 10 due to the interruption of the electric current supplied to the electric motor 20, the guard mechanism 50 can serve the same function. In other words, the throttle valve 10 is manually opened or closed.

When the throttle valve is fully closed following the condition of FIG. 4(*b*), the pulley 52 has the opening of 0° as shown in FIG. 5(*a*). The opening of the throttle valve 10 decreases to $\theta_2$ (e.g. 2°) after the protrusion 13' (the protrusion 13 in FIG. 4(*b*)) has moved to the position shown by the reference numeral 13 in FIG. 5(*a*). To be more specific, the edge face of the notched portion 55 of the lever pulley 54 pushes the protrusion 13 to fully or almost fully close the throttle valve. This allows for full closing or compulsory return of the throttle valve through manual operation even in emergency situations.

When the throttle valve is fully opened following the condition shown in FIG. 5(*a*), the edge face of the notched portion 55 of the lever pulley 54 can push the protrusion 13, which can increase the throttle opening from $\theta_2$ to $\theta_3$ (e.g. 5°). The throttle opening of $\theta_3$ allows the two-wheeled motor vehicle 1000 to run at a slow speed.

As described above, in the electronic throttle valve system 100 according to the present invention, the throttle opening sensor 40 and the guard mechanism 50 are provided respectively on the right end 12*a* and the left end 12*b* of the valve shaft 12 of the throttle valve 10, and the throttle cable 62 is engaged with the guard mechanism 50. This allows the throttle cable 62 to be disposed with an appropriate curvature, resulting in establishment of the electronic throttle valve system that is more suitable for use in two-wheeled motor vehicles.

The two-wheeled motor vehicle 1000 shown in FIGS. 2 and 3 is an on-road vehicle. However, the invention is not limited to that, but may also be applied to any off-road two-wheelers. The term "two-wheeled motor vehicle" used herein means a motorcycle, including every motorbike and motor scooter, and, more particularly, is a vehicle which can be turned by tilting the vehicle body. Thus, a vehicle equipped with two or more front wheels and/or two or more rear wheels, thus having three or four (or more) wheels in total is also included in the "two-wheeled motor vehicle."

Without any limitation to two-wheeled motor vehicles, the invention may also be applied to other vehicles, as long as a vehicle can take advantage of effects of the invention. The other vehicles include so-called straddle type vehicles, such as four-wheeled buggies or all terrain vehicles (ATV) 2000 and snowmobiles.

While the invention is explained above by way of preferable embodiments, such descriptions are not limiting items. Therefore, various modifications may be made. For example, in the above embodiment, the accelerator-opening sensor 70 is mounted on the guard mechanism 50, but the invention is not limited to that. In other words, as long as the opening of the accelerator would be detected, the accelerator-opening sensor 70 may use the opening of the throttle grip, for example, and accordingly the layout of the sensor 70 may be changed for convenience.

The present invention provides the excellent advantages as described above. However, the practical application of the invention to straddle type vehicles should involve consideration of the embodiments from an overall viewpoint including other requirements.

The present invention provides an electronic throttle valve system more suitable for use in straddle type vehicles.

The invention claimed is:

1. A straddle type vehicle having an electronic throttle valve system for adjusting the amount of intake air to an internal combustion engine, the electronic throttle valve system comprising:

a throttle valve for adjusting the amount of intake air to the internal combustion engine;

an electric motor for actuating the throttle valve; and a control unit for controlling the electric motor, wherein the throttle valve is fixed to a valve shaft;

the electric motor, connected to the valve shaft, is located for actuating the throttle valve through the valve shaft;

the valve shaft is provided with, on a right end thereof, a throttle opening sensor for detecting the opening of the throttle valve; and the valve shaft is provided with, on a left end thereof, a mechanical, throttle valve actuating mechanism with which a throttle cable is engaged, the throttle cable being coupled to an acceleration controller provided on a right one of a pair of handlebars of the straddle type vehicle, the mechanical, throttle valve actuating mechanism has a structure for actuating the throttle valve in conjunction with the operation of the throttle grip, in the event that the electric motor stops actuating the throttle valve, the mechanical, throttle valve actuating mechanism is provided with an accelerator-opening sensor for detecting the displacement of the acceleration controller; the accelerator-opening sensor is in electrical connection with the control unit; and the control unit controls the electrical motor based on the opening of the acceleration controller detected by the accelerator-opening sensor, and wherein the electric motor is connected via a drive gear to a midsection between the right end and the left end of the valve shaft.

2. The straddle type vehicle according to claim 1, wherein the valve shaft is placed so as to extend in the lateral direction of the straddle type vehicle; and the accelerator-opening sensor and the electric motor are located either forward or rearward of the valve shaft.

3. A straddle type vehicle having an electronic throttle valve system for adjusting the amount of intake air to an internal combustion engine, the electronic throttle valve system comprising:

a throttle valve for adjusting the amount of intake air to the internal combustion engine;

an electric motor for actuating the throttle valve; and a control unit for controlling the electric motor, wherein the throttle valve is fixed to a valve shaft;

the electric motor, connected to the valve shaft, is located for actuating the throttle valve through the valve shaft;

the valve shaft is provided with, on a right end thereof, a throttle opening sensor for detecting the opening of the throttle valve; and the valve shaft is provided with, on a left end thereof, a mechanical, throttle valve actuating mechanism with which a throttle cable is engaged, the throttle cable being coupled to an acceleration controller provided on a right one of a pair of handlebars of the straddle type vehicle, the mechanical, throttle valve actuating mechanism has a structure for actuating the throttle valve in conjunction with the operation of the throttle grip, in the event that the electric motor stops actuating the throttle valve, the mechanical, throttle valve actuating mechanism is provided with an accelerator-opening sensor for detecting the displacement of the acceleration controller; the accelerator-opening sensor is in electrical connection with the control unit; and the control unit controls the electrical motor based on the opening of the acceleration controller detected by the accelerator-opening sensor, the valve shaft is placed so as to extend in the lateral direction of the straddle type vehicle; and the accelerator-opening sensor and the electric motor are located either forward or rearward of the valve shaft, and wherein the throttle cable extends from the throttle grip to the left end of the valve shaft with a greater curvature of the cable, compared to the case where the cable extends to the right end of the valve shaft or the midsection between the right end and the left end thereof.

4. The straddle type vehicle according to claim 3, wherein the straddle type vehicle is a two-wheeled motor vehicle with the electronic throttle valve system and the mechanical, throttle valve actuating mechanism both installed inside a body frame.

* * * * *